US008015799B2

(12) United States Patent
Tamura et al.

(10) Patent No.: US 8,015,799 B2
(45) Date of Patent: Sep. 13, 2011

(54) MULTICYLINDER INTERNAL COMBUSTION ENGINE

(75) Inventors: Yasuki Tamura, Yokohama (JP); Kazuhito Kawashima, Okazaki (JP)

(73) Assignees: Mitsubishi Jidosha Kogyo Kabushiki Kaisha, Tokyo (JP); Mitsubishi Jidosha Kogyo K.K., Tokyo (JP)

( * ) Notice: Subject to any disclaimer, the term of this patent is extended or adjusted under 35 U.S.C. 154(b) by 70 days.

(21) Appl. No.: 11/171,368

(22) Filed: Jul. 1, 2005

(65) Prior Publication Data

US 2006/0000204 A1 Jan. 5, 2006

(30) Foreign Application Priority Data

Jul. 5, 2004 (JP) ..... 2004-198263

(51) Int. Cl.
*F01N 3/00* (2006.01)

(52) U.S. Cl. ..... 60/276; 60/287; 60/299; 60/323; 73/23.31

(58) Field of Classification Search ..... 60/299, 60/276, 278, 323, 287, 288; 73/23.31, 23.32
See application file for complete search history.

(56) References Cited

U.S. PATENT DOCUMENTS 4,484,440 A * 11/1984 Oki et al. ..... 60/276
4,534,213 A * 8/1985 Mirikidani ..... 73/118.1
4,833,882 A 5/1989 Yasuda et al.
5,408,215 A * 4/1995 Hamburg ..... 340/439
5,450,749 A * 9/1995 Strom et al. ..... 73/117.3
5,625,156 A * 4/1997 Serrels et al. ..... 73/863.51
5,711,148 A * 1/1998 Katoh ..... 60/276
5,832,907 A * 11/1998 Kato ..... 123/672
5,836,155 A 11/1998 Katoh et al.
5,907,109 A * 5/1999 Tedeschi ..... 73/864.73
6,058,701 A * 5/2000 Mashiki ..... 60/285
6,119,453 A * 9/2000 Motose et al. ..... 60/285
6,135,100 A * 10/2000 Katoh ..... 123/679
6,458,267 B2 * 10/2002 Kaendler ..... 210/85
6,499,292 B2 * 12/2002 Kato ..... 60/284
6,694,726 B2 * 2/2004 Sakai ..... 60/277
6,796,117 B2 * 9/2004 Farmer et al. ..... 60/285
6,826,902 B2 * 12/2004 Sun et al. ..... 60/274
6,962,047 B2 * 11/2005 Yoshida et al. ..... 60/300
7,089,811 B2 * 8/2006 Allmendinger ..... 73/863.51

FOREIGN PATENT DOCUMENTS

EP 0715064 6/1996
GB 1569948 6/1980
JP 11-280458 A 10/1999

* cited by examiner

*Primary Examiner* — Tu M Nguyen
(74) *Attorney, Agent, or Firm* — Birch, Stewart, Kolasch & Birch, LLP

(57) ABSTRACT

There is provided a multicylinder internal combustion engine. Branches of an exhaust manifold are connected to a common exhaust gas sensor via respective exhaust communication passages. The exhaust gas sensor detects the exhaust air-fuel ratio of each cylinder. The distance from exhaust ports of the engine to the exhaust gas sensor is set to be shorter than the distance from the exhaust ports to a catalyst disposed in an exhaust pipe.

12 Claims, 10 Drawing Sheets

MULTICYLINDER INTERNAL COMBUSTION ENGINE

BACKGROUND OF THE INVENTION

1. Field of the Invention

The present invention relates to a multicylinder internal combustion engine, and more particularly to a multicylinder internal combustion engine in which an exhaust gas sensor for determining the exhaust air-fuel ratio is provided in an exhaust system.

2. Description of the Related Art

As one of exhaust emission control devices which purify exhaust gas in an internal combustion engine, catalysts are provided in an exhaust passage of the engine. The air-fuel ratio of exhaust gas flowing into the catalysts must be controlled to an approximately stoichiometric ratio so that the catalysts can offer satisfactory performance. A multicylinder internal combustion engine adapted to attain such an object has been disclosed in Unexamined Japanese Patent Publication No. 11-280458, for example. In this multicylinder internal combustion engine, exhaust gas sensors such as an $O_2$ sensor are disposed in the vicinity of the inlets of the catalysts so that the air-fuel ratio of the internal combustion engine can be controlled based on the exhaust air-fuel ratio of determined by the exhaust gas sensors. It should be noted that the catalysts are provided in respective one of a pair of exhaust passages located upstream of a junction thereof, and a common exhaust gas sensor is provided in a communication passage that brings the exhaust passages in the vicinity of the inlets of the catalysts into communication with each other.

In the case where the exhaust gas sensors are provided in the vicinity of the inlets of the catalysts as is the case with the above internal combustion engine, an exhaust system with a certain degree of volume exists upstream of the exhaust gas sensors. Thus, determination of the air-fuel ratio by the exhaust gas sensors has a delay corresponding to a delay in exhaust gas transmission which occurs due to the volume of the exhaust system. Also, in the case where the air-fuel ratio of the internal combustion engine is controlled based on the exhaust air-fuel ratio determined by the exhaust gas sensors, fluctuation in air-fuel ratio (self-excited fluctuation in air-fuel ratio) necessarily occurs due to the delay in the determination of exhaust air-fuel ratio. If there is a long delay in the determination of exhaust air-fuel ratio, the amplitude of fluctuation in the air-fuel ratio of air-fuel mixture supplied to the internal combustion engine is increased. As a result, fuel economy is likely to deteriorate due to an increase in the amplitude of fluctuation to the rich side, and also, combustion is likely to deteriorate due to an increase in the amplitude of fluctuation to the lean side.

The delay in the determination of exhaust air-fuel ratio can be eliminated by, for example, attaching exhaust gas sensors to respective exhaust ports of the internal combustion engine to reduce the volume of the exhaust system located upstream of the exhaust gas sensors. In this case, however, it is necessary to provide the exhaust gas sensors for the respective exhaust ports if the internal combustion engine is a multicylinder type, and hence another problem that manufacturing costs increase arises.

SUMMARY OF THE INVENTION

An aspect of the present invention is a multicylinder internal combustion engine including a plurality of cylinders, comprising: exhaust passages connected to exhaust ports of the respective cylinders; a catalyst provided in the exhaust passages, for purifying exhaust gas; exhaust communication passages in communication with at least two of the exhaust ports; and an exhaust gas sensor provided in the exhaust communication passages, wherein the distance from the exhaust ports to the exhaust gas sensor is shorter than the distance from the exhaust ports to the upstream inlet of the catalyst.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE INVENTION

A description will hereunder be given of a multicylinder internal combustion engine according to a first embodiment of the present invention.

Figure 1:
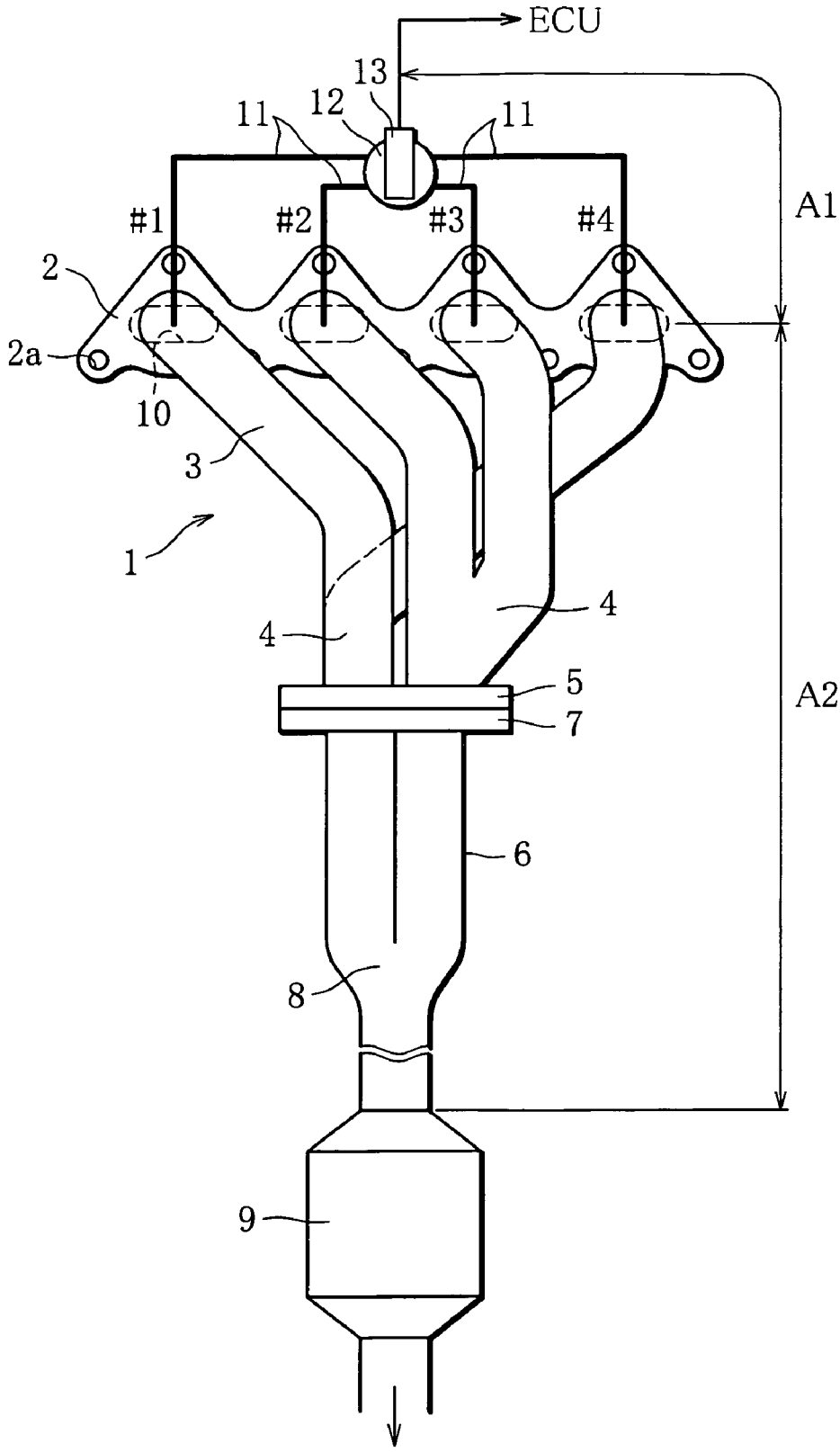
FIG. 1 is a diagram showing the overall construction of a multicylinder internal combustion engine according to a first embodiment of the present invention.

FIG. 1 is a view showing the overall construction of the multicylinder internal combustion engine according to the first embodiment. The internal combustion engine according to the first embodiment is implemented by a straight four-cylinder engine. In FIG. 1, only an exhaust system of the internal combustion engine is illustrated the main body of the internal combustion engine omitted. An upstream flange 2 of an exhaust manifold 1 (exhaust passage) is connected to a side of a cylinder head of the internal combustion engine by bolts, not shown, through bolt holes 2*a* formed at the periphery of the flange 2. The upper parts of respective branches 3 are welded to the upstream flange 2 in a manner corresponding to exhaust ports 10 of respective cylinders. The downstream sides of the blanches 3 of the first cylinder #1 and the fourth cylinder #4 join together to form one of two exhaust passage junctions 4; the downstream sides of the blanches 3 of the second cylinder #2 and the third cylinder #3 join together to form the other one of the exhaust passage junctions 4. The exhaust passage junctions 4 are welded to a downstream flange 5.

A flange 7 of an exhaust pipe 6 (exhaust passage) is connected to the downstream flange 5 of the exhaust manifold 1 by bolts, not shown. The upstream side of the exhaust pipe 6 connected to the flange 7 is bifurcated to be in communication with the respective exhaust passage junctions 4 of the exhaust manifold 1. The downstream sides of the exhaust pipe 6 join together at an exhaust passage junction 8 and connected to a catalyst 9. Further, the exhaust pipe 6 is extended to the rear of a vehicle via a muffler, not shown. Therefore, when the internal combustion engine is operating, exhaust gases emitted from the exhaust ports 10 sequentially join together while being guided in the exhaust manifold 1 and the exhaust pipe 6, and then emitted to the outside via the catalyst 9 and the muffler.

One ends of respective pipe-shaped exhaust communication passages 11 are connected to the respective branches 3 of the exhaust manifold 1 in the vicinity of areas where the branches 3 are welded to the upstream flange 2. The other ends of the respective exhaust communication passages 11 are connected to a sensor fixing base 12 to join together at one point.An exhaust gas sensor 13 is fixed to the sensor fixing base 12; the exhaust gas sensor 13 and the exhaust communication passages 11 are in communication with each other within the sensor fixing base 12. It should be noted that the exhaust gas sensor 13 may be implemented by any of an $O_2$ sensor, air-fuel ratio sensor, $NO_x$ sensor, and so forth. Also, it should be noted that the exhaust communication passages 11 may be connected to exhaust ports, not shown, not to the exhaust manifold 1.

The exhaust gas sensor 13 is electrically connected to an ECU (Electronic Control Unit) aboard the vehicle; the output from the exhaust gas sensor 13 is input to the ECU. The ECU provides air-fuel ratio control requiring small fluctuation in air-fuel ratio for the internal combustion engine based on the exhaust air-fuel ratio determined by the exhaust gas sensor 13, such as air-fuel ratio feedback control and inflammability limit control.

The exhaust communication passages 11 are extended upward from the respective branches 3 and bent at about 90 degrees to reach the sensor fixing base 12 located between the second cylinder #2 and the third cylinder #3. Thus, the exhaust communication passages 11 as a whole are located just above the exhaust manifold 1. Because of this layout, the distance A1 along the exhaust communication passages 11 from the exhaust ports 10 to the exhaust gas sensor 13 can be kept to the minimum necessary. Thus, although the exhaust communication passages 11 differ in length according to the cylinders, the distance A1 of even the longer exhaust communication passage 11 for the first cylinder #1 or fourth cylinder #4 is considerably shorter than the distance A2 from the exhaust ports 10 to the upstream inlet of the catalyst 9.

In the multicylinder internal combustion engine according to the present embodiment constructed as described above, the exhaust air-fuel ratio is determined by the exhaust-gas sensor 13 as described below.

When the internal combustion engine is operating, exhaust gases are sequentially emitted from the exhaust ports 10 in the order of ignition, i.e., the exhaust ports 10 of the cylinders #1, #3, #4, and #2 in this order and flow in the branches 3 of the exhaust manifold 1. Part of the exhaust gases in the branches 3 are taken into the exhaust communication passages 11. The exhaust gases that have been taken into the exhaust communication passages 3 reach the exhaust gas sensor 13 via the exhaust communication passages 11 mainly because of a gas diffusing action. The exhaust gas sensor 13 sequentially detects the air-fuel ratio of exhaust gases from the respective cylinders, which are supplied via the exhaust communication passages 11. Because the distance Al from the exhaust ports 10 to the exhaust gas sensor 13 is very short as mentioned above, the delay in the transmission of exhaust gases emitted from the exhaust ports 10 to the exhaust gas sensor 13 can be suppressed to the minimum. Therefore, as compared with a conventional layout in which the exhaust gas sensor 13 is attached to the upstream inlet of the catalyst 9, more responsive determination of the exhaust air-fuel ratio can be realized.

As a result, the air-fuel ratio control carried out by the ECU based on the determined air-fuel ratio can be made more responsive, which makes it possible to solve the problem that exhaust gas components are emitted without being properly purified by the catalyst. This prevents deterioration of purifying performance. Also, the responsive air-fuel ratio control can realize high-speed self-excited fluctuation in which fluctuation in air-fuel ratio is small. This prevents fuel economy from being deteriorated by an increase in the amplitude of fluctuation to the rich side and prevents combustion from being deteriorated due to an increase in the amplitude of fluctuation to the lean side. Further, as shown in the characteristic diagram of FIG. 2, the purifying efficiency at a cross-over point (COP) of THC (Total Hydro Carbon) and $NO_x$ can be improved as the fluctuation period of air-fuel ratio is shortened.

On the other hand, exhaust gases emitted from the respective cylinders are led to the common exhaust gas sensor 13 via the exhaust communication passages 11 so as to detect the air-fuel ratio. For this reason, as compared with e.g., the case where exhaust gas sensors 13 are provided in exhaust ports of respective cylinders, the required number of exhaust gas sensors 13 can be reduced, which makes it possible to reduce manufacturing costs for the internal combustion engine.

Further, as is apparent from FIG. 1, the exhaust communication passages 11 are connected to each other via the exhaust gas sensor 13 without being in direct communication with each other. With this arrangement, part of pressure pulsations generated in the exhaust communication passages 11 is blocked by the exhaust gas sensor 13. Therefore, interference of exhaust gases between the respective cylinders can be suppressed to thereby prevent a decrease in the output of the engine.

Figure 2:
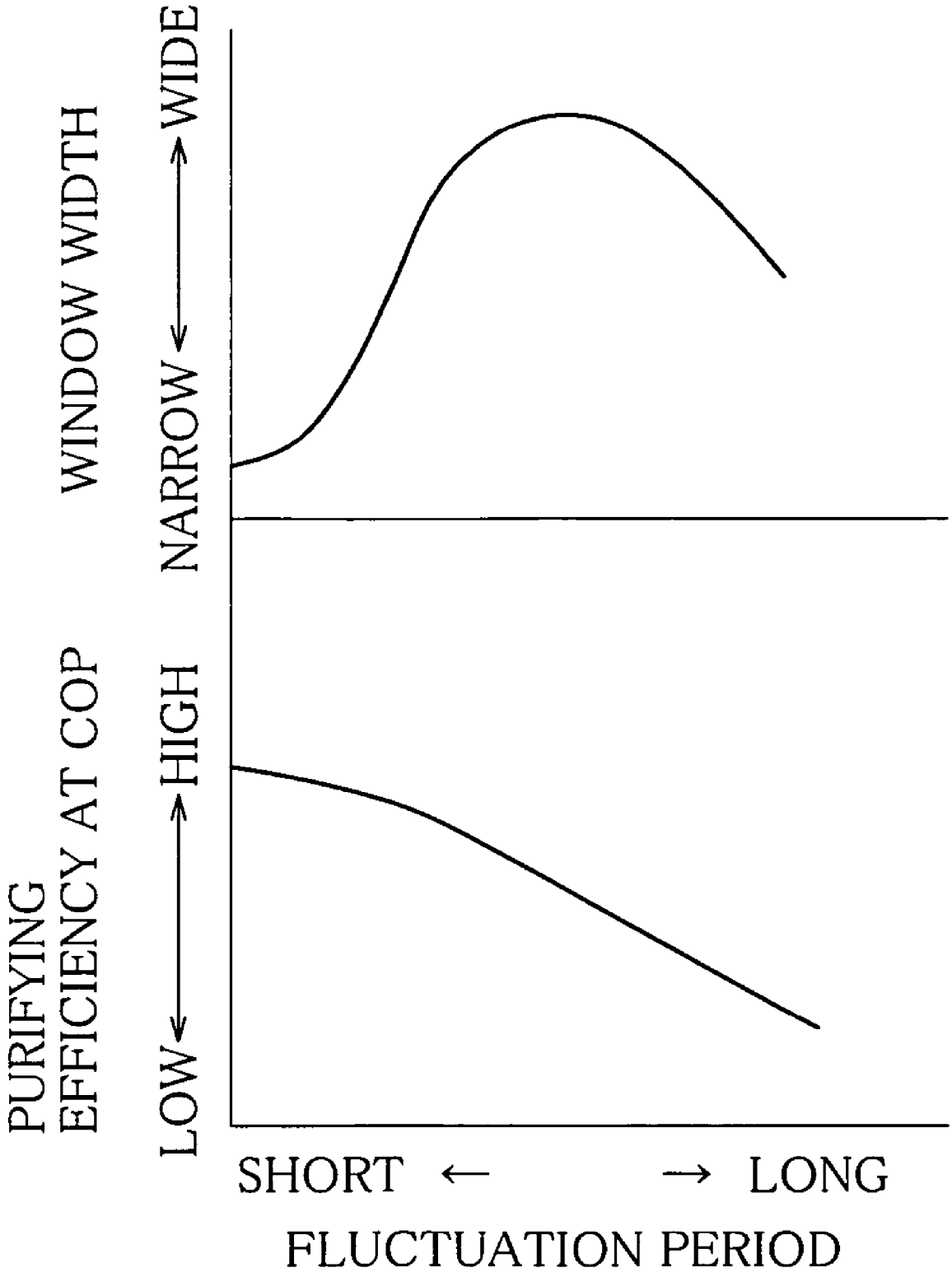
FIG. 2 is a characteristic diagram showing the relationship between the fluctuation period of air-fuel ratio and the emission control efficiency at a COP (Cross-Over Point) as well as the window width.

By the way, in the case where the high-speed self-excited fluctuation of the air-fuel ratio is carried out as mentioned above, the purifying efficiency at the COP can be improved, but the so-called window width of air-fuel ratio tends to be reduced due to a decrease in fluctuation period as shown in FIG. 2. Thus, in the case where the air-fuel ratio is controlled to be positively changed, or in the case where the air-fuel ratio has been shifted from a target air-fuel ratio due to some factors, the air-fuel ratio is likely to fall outside the window with high possibility if high-speed self-excited fluctuation is carried out. To address this problem, lean spike is carried out at regular time intervals, or lean spike is carried out after a predetermined rich air-fuel ratio is detected by the exhaust gas sensor 13 so that HC (Hydro Carbon) can be purged from the catalyst 9.

Also, to prevent emission of HC when the air-fuel ratio falls outside the window, an appropriate delay time is set for determination of the air-fuel ratio by the exhaust gas sensor 13 so as to extend the period of high-speed self-excited fluctuation on purpose. Even in this case, since the period of high-speed self-excited fluctuation can be arbitrarily set, the period of self-excited fluctuation can be reduced to the minimum possible level while the emission of HC is prevented. Therefore, more responsive determination of the air-fuel ratio can be realized as compared with conventional self-excited fluctuation of the air-fuel ratio.

Although in the present embodiment, the exhaust communication passages 11 of the respective cylinders join together at one point and connected to the single exhaust gas sensor 13, the present invention is not limited to this, but the layout of the exhaust communication passages 11 and the number of exhaust gas sensors 13 may be changed insofar as a smaller number of exhaust gas sensors 13 than the number of cylinders can be provided and the exhaust communication passages 11 of the respective cylinders can be connected to any of the exhaust gas sensors 13. Therefore, for example, the exhaust communication passages 11 of respective three cylinders may be connected to a single exhaust gas sensor 13, or the exhaust communication passages 11 of respective two cylinders may be connected to a single exhaust gas sensor 13.

By the way, in the present embodiment, exhaust gases are transferred in the exhaust communication passages 11 by the gas diffusing action as mentioned above. For this reason, exhaust gases tend to not so smoothly exchanged in the exhaust communication passages 11. Therefore, a description will now be given of second to fifth embodiments of the present invention, in which a gas exchange facilitating means for facilitating gas exchange in the exhaust communication passages 11. It should be noted that the basic arrangements (such as the distances A1 and A2) of the second to fifth embodiments are the same as the arrangement of the first embodiment, and the second to fifth embodiments differ from the first embodiment in that the above-mentioned gas exchange is facilitated. Thus, elements and parts corresponding to those of the first embodiment are denoted by the same reference numerals, and therefore the above-mentioned difference will be intensively explained below with duplicate description omitted.

Figure 3:
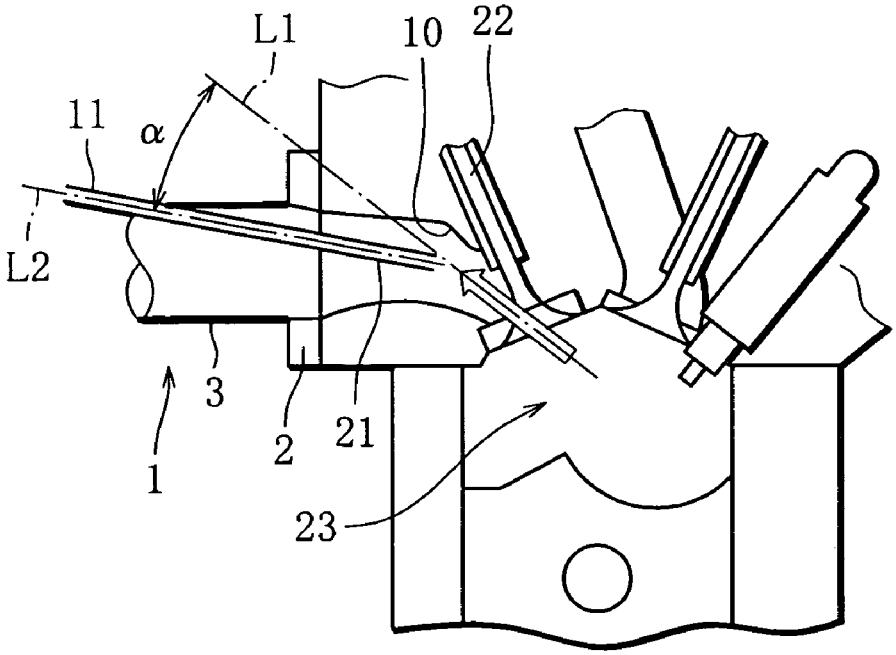
FIG. 3 is a sectional view showing an example of the state in which an exhaust communication passage is connected to an exhaust manifold in a multicylinder internal combustion engine according to a second embodiment of the present invention.

FIG. 3 is a sectional view showing the state in which the exhaust communication passage 11 is cormected to the exhaust manifold 1 in a multicylinder internal combustion engine according to the second embodiment of the present invention. In the second embodiment, in order to facilitate gas exchange, an inflow part 21 (gas exchange facilitating means) at an end of the exhaust communication passage 11 is disposed so that exhaust gas can easily flow into the exhaust communication passage 11. The exhaust communication passage 11 according to the first embodiment is merely at a right angle to the branch 3 of the exhaust manifold 1. On the other hand, in the second embodiment, the exhaust communication passage 11 is inclined so that the inflow part 21 approaches the cylinder head, and the inflow part 21 is protruded into the branch 3 and located in the vicinity of an exhaust valve 22 in each exhaust port 10.

In the vicinity of the exhaust valve 22 in the exhaust port 10, exhaust gas from a combustion chamber 23 is emitted diagonally upward along an exhaust gas flow line L1 indicated by the arrow in FIG. 3. An inflow line L2 i.e., the axis of the inflow part 21) along which exhaust gas flows into the inflow part 21 of the exhaust communication passage 11 is at a sharp angle a anglαto the exhaust gas flow line L1 Therefore, exhaust gas emitted from the combustion chamber 23 into the exhaust port 10 positively flows into the inflow part 21 of the exhaust communication passage 11 due to kinetic energy during emission and reaches the exhaust gas sensor 13 via the exhaust communication passage 11.

As a result, as compared with the first embodiment in which exhaust gas is transferred mainly by the gas diffusing action, exhaust gases in the respective cylinders can be smoothly transferred to the exhaust gas sensor 13 via the exhaust communication passages 11 to thereby facilitate gas exchange in the exhaust communication passages 11. Therefore, determination of the air-fuel ratio by the exhaust gas sensor 13 can be made more responsive as compared with the first embodiment.

Figure 4:
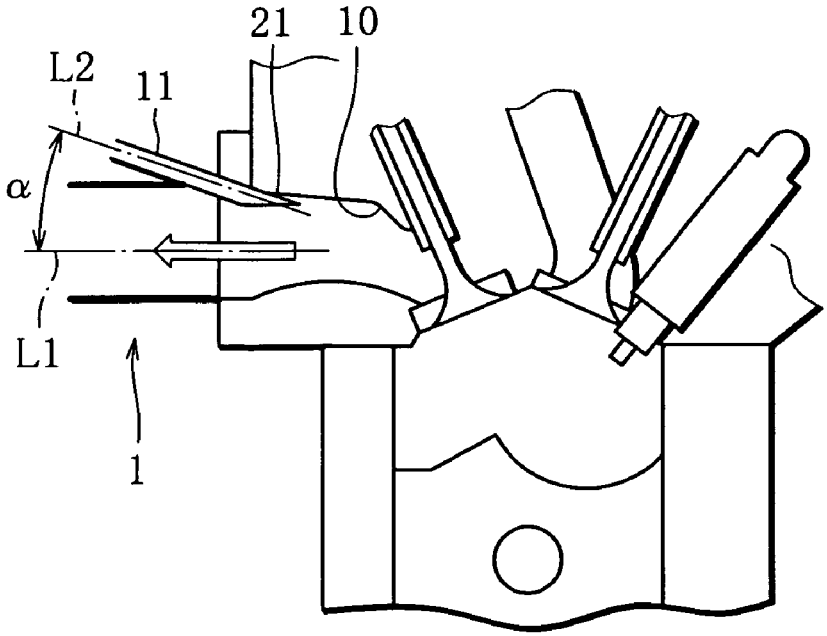
FIG. 4 is a sectional view showing another example of the state in which the exhaust communication passage is connected to the exhaust manifold in the multicylinder internal combustion engine according to the second embodiment.

It should be noted that the connected state of the exhaust communication passages 11 is not limited to the present embodiment, but the exhaust communication passage 11 may be connected to the exhaust manifold 1 as shown in FIG. 4, for example. In the example shown in FIG. 4, the exhaust communication passage 11 is inclined as mentioned above, and the inflow part 21 of the exhaust communication passage 11 is opened in the vicinity of the outlet of the exhaust port 10. At the outlet of the exhaust port 10, exhaust gas flows substantially horizontally along an exhaust gas flow line L1 indicated by the arrow in FIG. 4. An inflow line L2 along which exhaust gas flows into the inflow part 21 is at a sharp angle $\alpha$ to the exhaust gas flow line L1, and hence the same effects as in the second embodiment can be obtained.

Figure 5:
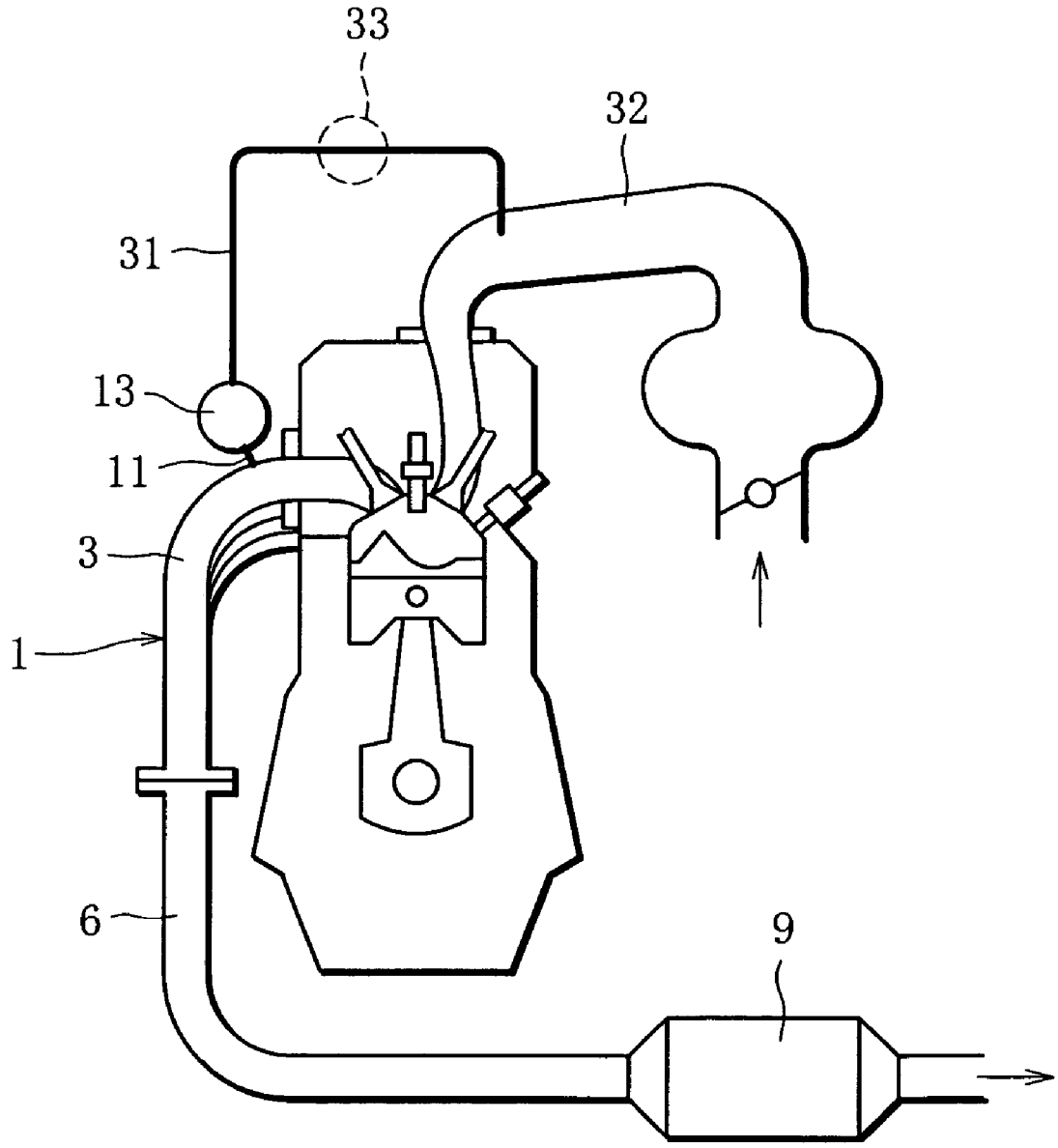
FIG. 5 is a view showing the connected state of an intake communication passage in a multicylinder internal combustion engine according to a third embodiment of the present invention.

FIG. 5 is a view showing the connected state of an intake communication passage in a multicylinder internal combustion engine according to a third embodiment of the present invention. In the third embodiment, to facilitate gas exchange, the exhaust gas sensor 13 is connected to an intake system of the internal combustion engine so as to cause a difference in pressure before and after the exhaust gas sensor 13. Specifically, in the first embodiment, only the exhaust communication passages 11 are connected to the exhaust gas sensor 13, but in the present embodiment, an end of one intake communication passage 31 (gas exchange facilitating means) as well as the exhaust communication passages 11 is connected to the exhaust gas sensor 13. Therefore, the exhaust gas sensor 13 is in communication with the branches 3 of the exhaust manifold 1 for the respective cylinders via the exhaust communication passage 11, and is also in communication with an intake manifold 32 via the intake communication passage 31.

While exhaust pressure (positive pressure) acts on the branches 3 to which the exhaust communication passages 11 are connected, intake pressure (negative pressure) acts on the intake manifold 32 to which the intake communication passage 31 is connected. For this reason, there is a difference in pressure before and after the exhaust gas sensor 13. Thus, exhaust gases in the exhaust communication passages 11 flow into the low-pressure intake communication passage 31 via the exhaust gas sensor 13. As a result, exhaust gases in the respective cylinders are smoothly transferred to the exhaust gas sensor 13 via the exhaust communication passages 11, so that gas exchange in the exhaust communication passages 11 can be facilitated.

By the way, to prevent the intake communication passage 31 from being obstructed by the flow of exhaust gas, the intake communication passage 31 must have a certain degree of cross-sectional area. Therefore, a larger amount of exhaust gas than the amount of exhaust gas required for facilitating gas exchange tends to flow back into the intake manifold 32 via the intake communication passage 31. Thus, in the case where the EGR (Exhaust Gas Recirculation) amount is increased to the limit of inflammability or its vicinity in EGR control so as to reduce $NO_x$, exhaust gas flowing back into the intake manifold 32 via the intake communication passage 31 may cause deterioration of combustion. To address this problem, as indicated by the broken line in FIG. 5, a switching valve 33 may be provided in the intake communication passage 31; the opening of the switching valve 33 is reduced or eliminated in a certain operating range where the above-mentioned deterioration of combustion may occur. Therefore, the amount of exhaust gas flowing back to the intake manifold 32 via the intake communication passage 31 can be limited to thereby prevent the deterioration of combustion.

Figure 6:
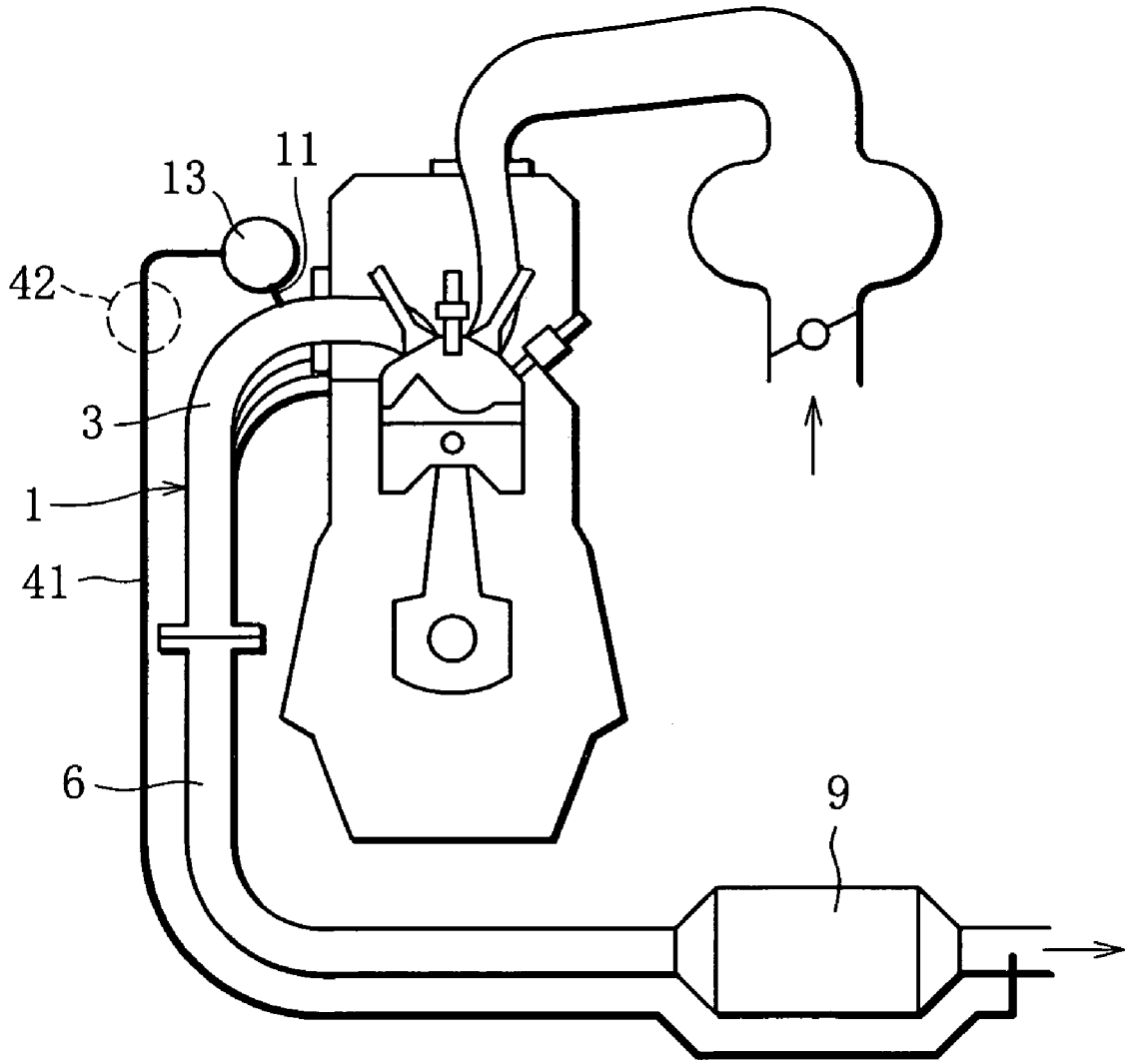
FIG. 6 is a view showing the connected state of an exhaust downstream communication passage in a multicylinder internal combustion engine according to a fourth embodiment of the present invention.

FIG. 6 is a view showing the connected state of an exhaust downstream communication passage in a multicylinder internal combustion engine according to a fourth embodiment of the present invention. In the fourth embodiment, to facilitate gas exchange, the exhaust gas sensor 13 is connected to the downstream side of the catalyst 9 in the exhaust pipe 6 to cause a difference in pressure before and after the exhaust gas sensor 13. Specifically, an end of one exhaust downstream communication passage 41 (gas exchange facilitating means) in place of the intake communication passage 31 according to the third embodiment is connected to the exhaust gas sensor 13. The exhaust downstream communication passage 41 is extended along the exhaust pipe 6 to the downstream side of the exhaust pipe 6, and has the other end thereof connected to the downstream side of the catalyst 9.

As compared with the branches 3 of the exhaust manifold 1 to which the exhaust communication passages 11 are connected, in an area downstream of the catalyst 9 to which the exhaust downstream communication passage 41 is connected, the exhaust pressure is decreased due to the venturi action, etc. of the catalyst 9, and hence there is a difference in pressure before and after the exhaust gas sensor 13. Therefore, exhaust gases in the exhaust communication passages 11 flow into the low-pressure exhaust downstream communication passage 41 via the exhaust gas sensor 13. As a result, exhaust gases in the respective cylinders are smoothly transferred to the exhaust gas sensor 13 via the exhaust communication passages 11, so that gas exchange in the exhaust communication passages 11 can be facilitated.

By the way, at the time of cold-start, unburned gas generated due to an increase in the amount of fuel is emitted via the exhaust downstream communication passage 41 while bypassing the catalyst 9. To address this problem, a switching valve 42, which is the same as the switching valve 33 of the third embodiment, may be provided in the exhaust downstream communication passage 41 as indicated by the broken line in FIG. 6. In this case, at the time of e.g., the above-mentioned cold-start, the opening of the switching valve 42 may be reduced or eliminated to limit the amount of exhaust gas flowing in the exhaust downstream communication passage 41, thus preventing emission of unburned gas.

It should be noted that the exhaust downstream communication passage 41 should not necessarily be connected to the downstream side of the catalyst 9, but may be connected to the upstream side of the catalyst 9. In this case, if the exhaust downstream communication passage 41 is connected to the downstream side of the existing venturi provided in the exhaust pipe 6 or another venturi for causing a difference in pressure, the same venturi effect as the effect obtained by the above catalyst 9 can be obtained to facilitate gas exchange.

Figure 7:
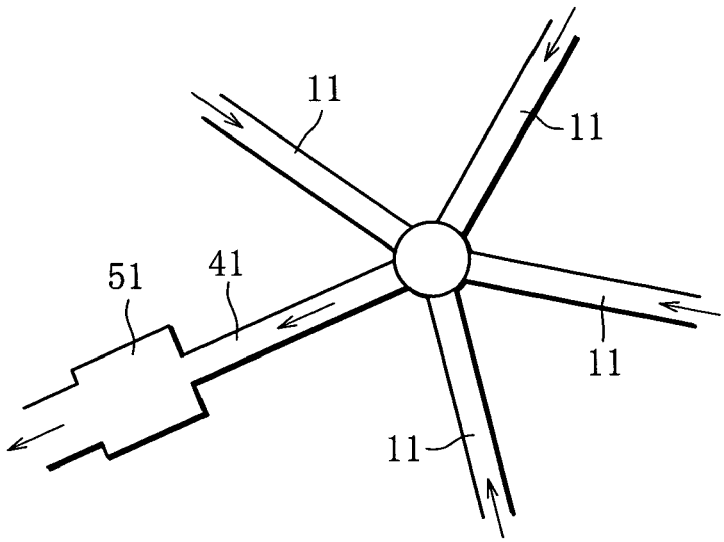
FIG. 7 is a view showing the connected state of a cooling space in a multicylinder internal combustion engine according to a fifth embodiment of the present invention.

FIG. 7 is a view showing the connected state of a cooling space in a multicylinder internal combustion engine according to a fifth embodiment of the present invention. In the fifth embodiment, to facilitate gas exchange, a cooling space 51 (gas exchange facilitating means) is provided in the exhaust downstream communication passage 41 of the above described fourth embodiment. Specifically, as is the case with the fourth embodiment, the exhaust gas sensor 13 is connected to the downstream side of the catalyst 9 in the exhaust pipe 6 via the exhaust downstream communication passage 41, and in the present embodiment, the cooling space 51 is additionally provided in the middle of the exhaust downstream communication passage 41.

Therefore, exhaust gas having passed through the exhaust gas sensor 13 is let into the cooling space 51 via the exhaust downstream communication passage 41 to change in volume (volume decrease) due to temperature decrease. With this change in volume, exhaust gas in the exhaust downstream communication passage 41 and upstream of the cooling space 51 is transferred into the cooling space 51, and exhaust gas in the exhaust communication passage 11 is transferred into the exhaust downstream communication passage 41 via the exhaust gas sensor 13. As a result, as compared with the fourth embodiment in which the cooling space 51 is omitted, gas exchange in the exhaust communication passages 11 can be further facilitated.

Here, to efficiently facilitate gas exchange in the exhaust communication passages 11 by means of the cooling space 51, it is preferred that substantially all of exhaust gases in the exhaust communication passages 11 are transferred to the exhaust downstream communication passage 41 as the volume of exhaust gas changes in the cooling space 51. To this end, at least one of the volume of the cooling space 51, the volume of the exhaust communication passages 11, and the rate of temperature decrease in the cooling space 51 is set so that a change in the volume of exhaust gas in the cooling space 51 and the volume of the exhaust communication passages 11 can be substantially equal.

It should be noted that the cooling space 51 should not necessarily be independently provided in the exhaust downstream communication passage 41, but it may be arranged such that the exhaust downstream communication passage 41 or a cooling system such as a fin or a cooling water channel provided in part of the exhaust downstream communication passage 41 functions as the cooling space 51.

Further, although in the present embodiment, the cooling space 51 is provided in the exhaust downstream communication passage 41, the cooling space 51 may be provided in the intake communication passage 31 of the above described third embodiment. In this case as well, the cooling space 51 can achieve the same effects as described above to further facilitate gas exchange.

This completes the description of the second to fifth embodiments relating to the gas exchange facilitating means, but other embodiments can be envisaged and will now be sequentially described.

A multicylinder internal combustion engine according to a sixth embodiment of the present invention differs from the multicylinder internal combustion engine according to the first embodiment, in which the exhaust communication passages 11 are provided outside the exhaust manifold 1, in that the exhaust manifold communication passages 11 are incorporated in the exhaust manifold 1.

Figure 8:
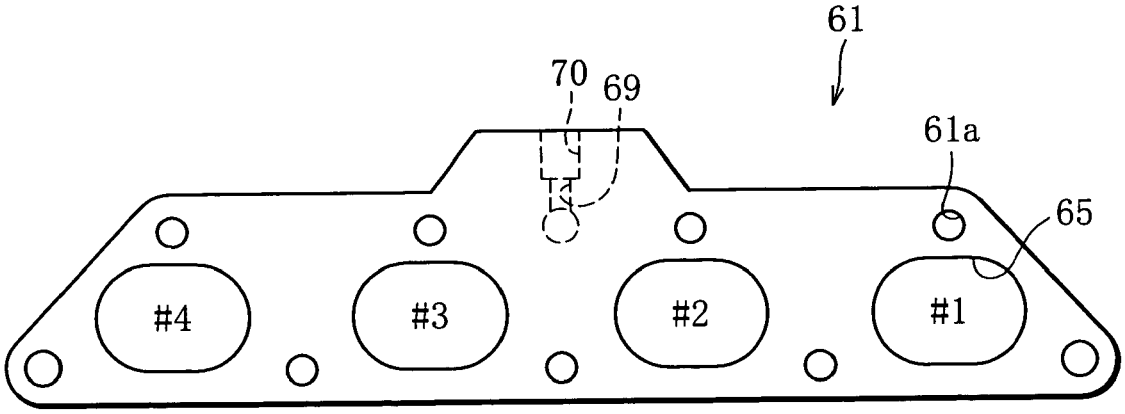
FIG. 8 is a front view showing an example of a head-side spacer member in a multicylinder internal combustion engine according to a sixth embodiment of the present invention.
Figure 9:
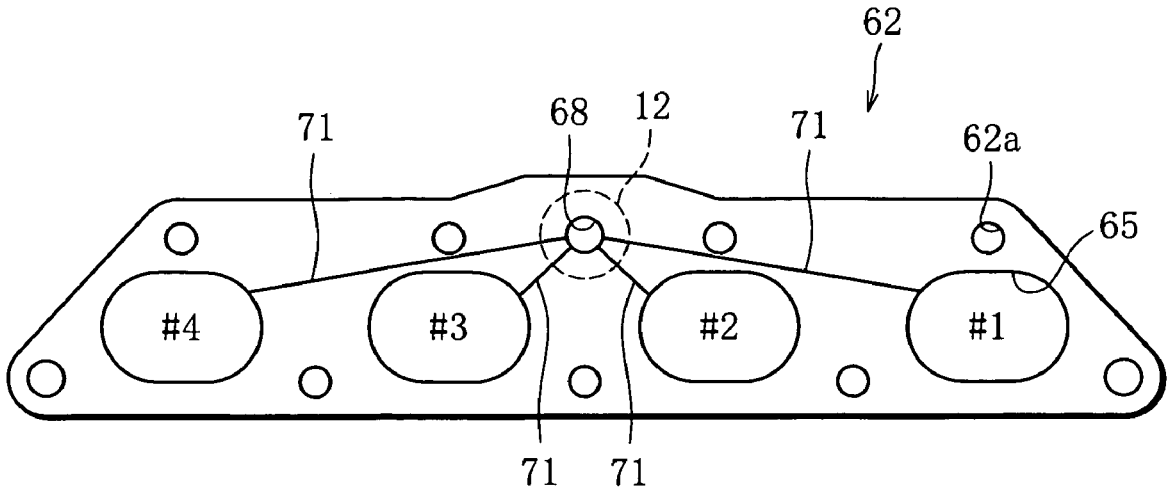
FIG. 9 is a front view showing a manifold-side spacer member in the multicylinder internal combustion engine according to the sixth embodiment.
Figure 10:
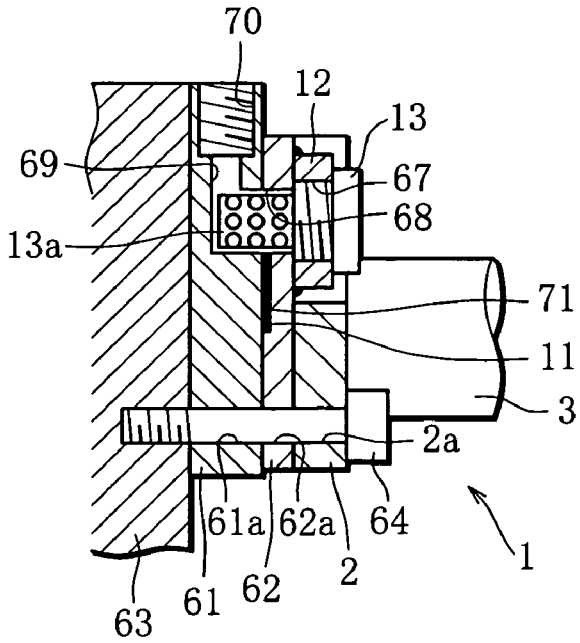
FIG. 10 is a sectional view showing the state in which spacer members are assembled according to the sixth embodiment.

FIG. 8 is a front view showing a head-side spacer member according to the present embodiment, FIG. 9 is a front view showing a manifold-side spacer member according to the present embodiment, and FIG. 10 is a sectional view showing how the spacer members are assembled according to the present embodiment. It should be noted that in the following description, the cylinder head side on the left side of FIG. 10 is referred to as "the head side", and the exhaust manifold side on the right side of FIG. 10 is referred to as "the manifold side." In FIGS. 8 and 9, each spacer member is viewed from the head side.

Each of the head-side spacer member 61 and the manifold-side spacer member 62 is in the form of a plate similar in shape to the upstream side flange 2 (see FIG. 1) of the exhaust manifold 1. The head-side spacer member 61 is disposed on the head side and the manifold-side spacer member 62 is disposed on the manifold side. The head-side spacer member 61 and the manifold-side spacer member 62 are interposed between a cylinder head 63 and the upstream side flange 2 of the exhaust manifold 1. The spacer members 61 and 62 are fastened by an exhaust manifold mounting bolt 64 through bolt holes 61*a* and 62*a* formed at the peripheries thereof, so that the spacer members 61 and 62 as well as the exhaust manifold 1 are fixed to the cylinder head 63. Exhaust gases from the exhaust ports 10 (see FIG. 1) flow into the exhaust manifold 1 through four port communication holes 65 formed in each of the spacer members 61 and 62.

The sensor fixing base 12, which is circular, is welded to a surface of the manifold-side spacer member 62 on the manifold side such that the sensor fixing base 12 is located at a slightly upper position between the port communication hole 65 of the second cylinder #2 and the port communication hole 65 of the third cylinder #3. An exhaust gas sensor-fixing screw hole 67 is formed at the center of the sensor fixing base 12, and an insertion hole 68 is formed in the manifold side spacer member 62 in a manner corresponding to the screw hole 67. An end of a bent passage 69 is opened in a surface of the head-side spacer member 61 on the manifold side in a manner corresponding to the insertion hole 68 of the manifold-side spacer member 62. The bent passage 69 is bent upward at a substantially right angle; the other end of the bent passage 69 is opened at the upper edge of the head-side spacer 61 via a screw hole 70.

The exhaust gas sensor 13 is engaged with and fastened in the screw hole 67 of the sensor fixing base 12. A detector 13*a* of the exhaust gas sensor 13 is located in the bent passage 69 as well as the insertion hole 68, and has an end thereof extended to substantially the innermost part of a horizontal section in the bent passage 69. On the other hand, an end of the intake communication passage 31 according to the above described third embodiment or the exhaust downstream communication passage 41 according to the fourth embodiment is connected to the screw hole 70 of the head-side spacer member 61. Therefore, the screw hole 70 is in communication with the intake manifold 32 of the internal combustion engine via the communication passage 31 or the downstream side of the catalyst 9 in the exhaust pipe 6 via the communication passages 41.

Four grooves 71 that connect the port communication holes 65 and the insertion hole 68 to each other are formed on a surface of the manifold-side spacer member 62 on the head side. As shown in FIG. 10, in the state in which the head-side spacer member 61 is overlapped on the manifold-side spacer member 62, the grooves 71 are closed by the head-side spacer member 61 to function as the exhaust communication passages 11 of the first embodiment, which bring the exhaust ports 10 and the exhaust gas sensor 13 into communication.

Also, in the present embodiment, the distance A1 from the exhaust ports 10 to the exhaust gas sensor 13 can be reduced to the minimum possible level as is the case with the first embodiment. The distance A1 is considerably shorter than the distance A2 (see FIG. 1) from the exhaust ports 10 to the upstream inlet of the catalyst 9. For this reason, the delay in the transmission of exhaust gases from the exhaust ports 10 to the exhaust gas sensor 13 can be suppressed to the minimum, and very responsive determination of the exhaust air-fuel ratio can be realized. Further, since exhaust gases from the respective cylinders are detected by the common exhaust gas sensor 13, manufacturing costs for the internal combustion engine can be reduced.

Further, since the exhaust communication passages 11 are formed in the spacer members 61 and 62 which are interposed between the cylinder head 63 and the upstream side flange 2 of the exhaust manifold 1, radiation of exhaust gases flowing in the exhaust communication passages 11 can be suppressed. Therefore, it is possible to achieve another advantage that exhaust gases are supplied to the exhaust gas sensor 13 while being maintained at high temperatures, and thus inactivation of the exhaust gas sensor 13 is prevented and quick activation of the exhaust gas sensor 13 is realized.

It should be noted that the arrangement for suppressing the radiation of exhaust gases in the exhaust communication passages 11 should not be limited to the above described one. For example, in the first embodiment in which the exhaust communication passages 11 are provided outside the exhaust manifold 1, the exhaust communication passages 11 may be configured as double pipes, or may be covered with a heat-retaining material. In this case as well, the radiation of exhaust gases can be suppressed to obtain the same effects as in the present embodiment. Also, instead of suppressing the radiation of exhaust gases, the exhaust gas sensor 13 may be positively heated to prevent inactivation of the exhaust gas sensor 13 and realize quick activation thereof.

On the other hand, the constructions of the head-side spacer member 61 and the manifold-side spacer member 62 are not limited to the above described ones. A variation thereof will now be described.

Although in the sixth embodiment, the head-side spacer member 61 is formed with the bent passage to connect the exhaust gas sensor 13 to the intake communication passage 31 and the exhaust downstream communication passage 41, the intake communication passage 31 and the exhaust downstream communication passage 41 may be omitted as is the case with the first embodiment. In this case, the facilitation of gas exchange due to a difference in pressure cannot be expected, but the radiation of exhaust gas can be suppressed as is the case with the sixth embodiment.

Figure 11:
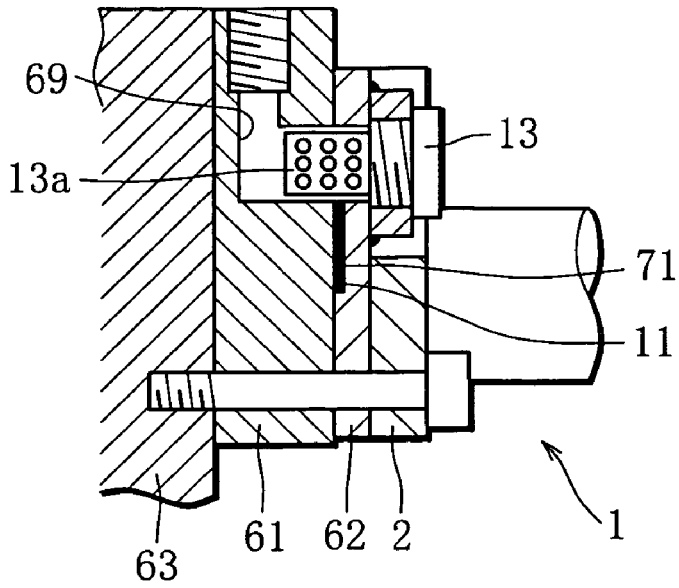
FIG. 11 is a sectional view showing another example where the head-side spacer member has an increased thickness according to the sixth embodiment.

In the sixth embodiment, the end of the detector 13*a* of the exhaust gas sensor 13 is located at substantially the innermost part of the horizontal section in the bent passage 69 as shown in FIG. 10. Alternatively, as shown in FIG. 11, the thickness of the head-side spacer member 61 may be increased so that the end of the detector 13*a* of the exhaust gas sensor 13 can be located in the middle of the horizontal section. In this case, exhaust gas flows to the detector 13*a* of the exhaust gas sensor differently from FIG. 10, and hence either of the arrangement in FIG. 10 and the arrangement in FIG. 11 can be selected according to characteristics, etc. of the exhaust gas sensor 13.

Figure 12:
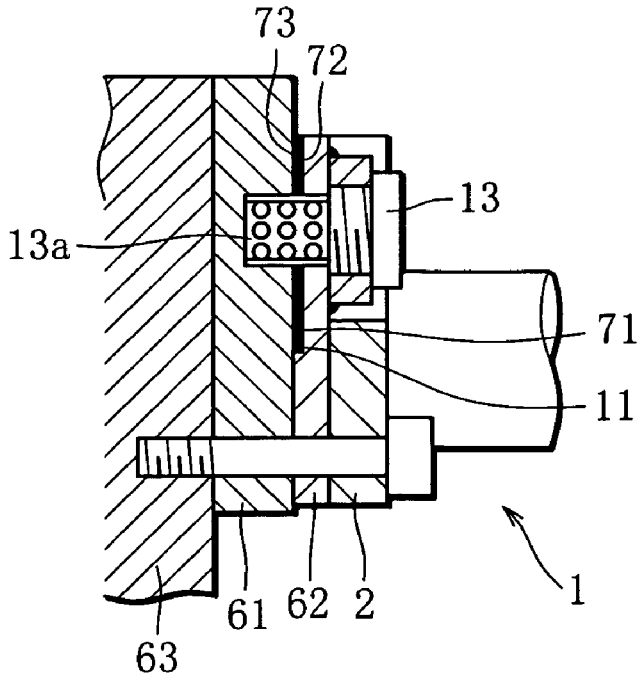
FIG. 12 is a sectional view showing another example where the manifold-side spacer member is formed with a groove instead of a bent passage according to the sixth embodiment.

In the sixth embodiment, the exhaust gas sensor 13 and the intake communication passage 31 or the exhaust downstream communication passage 41 are in communication with each other via the bent passage 69 formed in the head-side spacer member 61. However, in place of the bent passage 69, a groove 72 may be formed in the manifold-side spacer member 62 as is the case with the exhaust communication passage 11. Specifically, as shown in FIG. 12, one groove 72 extended upward from the detector 13*a* of the exhaust gas sensor 13 is formed in the manifold-side spacer member 62 and closed by the head-side spacer member 61 to form a passage 73, and an upper part of the passage 73 is connected to the intake communication passage 31 or the exhaust downstream communication passage 41. Machining the manifold-side spacer member 62 to form the groove 72 is considerably easier than machining the head-side spacer member 61 to form the bent passage 69, and therefore manufacturing costs can be reduced. Also, because the bent passage 69 is omitted, the thickness of the head-side spacer member 61 can be considerably reduced to make the internal combustion engine smaller.

Figure 13:
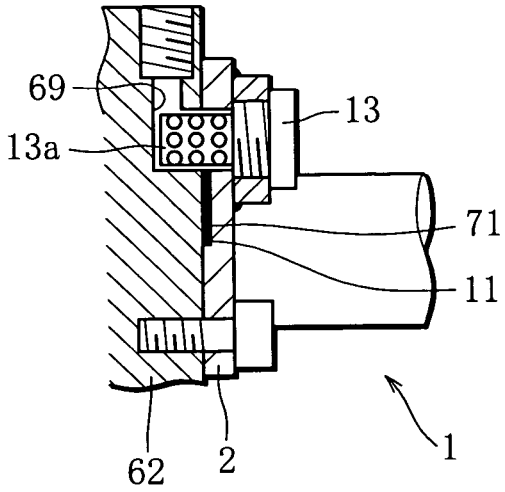
FIG. 13 is a sectional view showing another example where spacer members are omitted according to the sixth embodiment.

In the sixth embodiment, the head-side spacer member 61 and the manifold-side spacer member 62 are fabricated as members independent of the cylinder head 63 and the exhaust manifold 1, and the exhaust communication passage 11 and the exhaust gas sensor 13 are provided in the spacer members 61 and 62. However, either one or both of the spacer members 61 and 62 may be integrated with the cylinder head 63 and/or the exhaust manifold 1. FIG. 13 is a view showing an example where the head-side spacer member 61 is integrated with the cylinder head 63 and the manifold-side spacer member 62 is integrated with the exhaust manifold 1. In this case, the grooves 71 are formed on the upstream side flange 2 of the exhaust manifold 1 to fix the exhaust gas sensor 13, and on the other hand, the bent passage 69 is formed in the cylinder head 63 such that the bent passage 69 is in communication with the detector 13*a* of the exhaust gas sensor 13. With this arrangement, the internal combustion engine can be decreased in size by the thicknesses of the spacer members 61 and 62.

By the way, when the amount of gases exchanged in the exhaust communication passages 11 via the exhaust gas sensor 13 is not uniform, the effect of the air-fuel ratio of a specific cylinder on the output from the exhaust gas sensor 13 is increased or decreased, and hence the exhaust air-fuel ratio would not be correctly determined. Therefore, a description will now be given of a multicylinder internal combustion engine according to seventh and eighth embodiments of the present invention, which is adapted to make uniform the amount of gases exchanged in the exhaust communication passages 11.

Figure 14:
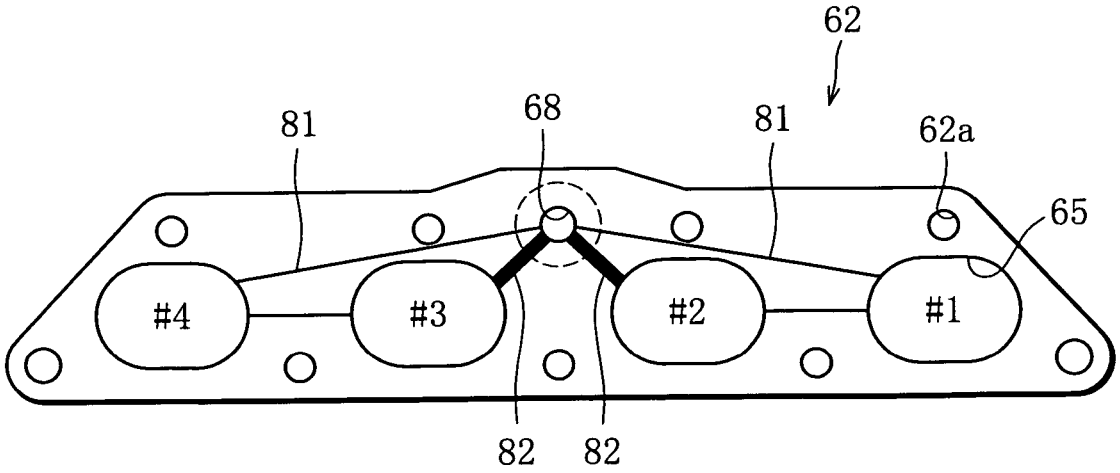
FIG. 14 is a front view showing a manifold-side spacer member in a multicylinder internal combustion engine according to a seventh embodiment of the present invention.

FIG. 14 is a front view showing a manifold-side spacer member of the multicylinder internal combustion engine according to the seventh embodiment. In the seventh embodiment, the amount of gases exchanged is made uniform by making the volumes of the exhaust communication passages 11 of the sixth embodiment substantially equal. Other than that, the multicylinder internal combustion engine of the seventh embodiment is identical in construction with that of the sixth embodiment, and therefore differences between them will be intensively described below.

As is the case with the sixth embodiment, four grooves 81 and 82 are formed on a surface of the manifold-side spacer member 62 on the head side. In the present embodiment, as compared with the grooves 81 for the first cylinder #1 and the fourth cylinder #4 far from the exhaust gas sensor 13, the grooves 82 for the second cylinders #2 and the third cylinder #3 near the exhaust gas sensor 13 are formed to be wider and larger in cross-sectional area although they have the same depth. Therefore, the volumes of all the exhaust communication passage 11 between the port communication holes 65 and the insertion hole 68 are substantially equal.

Since the volumes of the respective exhaust communication passages 11 are substantially equal, pressure pulsations generated when exhaust gases flow in them uniformly affect the exhaust gases and hence the uniform amount of gases are exchanged in the exhaust communication passages 11. As a result, the exhaust air-fuel ratio can be accurately determined with the air-fuel ratios of the respective cylinders being uniformly reflected.

It should be noted that to adjust the cross-sectional areas of the respective exhaust communication passages 11, the depths of the grooves 81 and 82 may be varied instead of the width, or the widths and depths of the grooves 81 and 82 may be varied.

Here, there may be a case where resonance of pressure pulsations occurs depending on the lengths of the respective exhaust communication passages 11. In this case, the resonance of pressure pulsations changes the flow rate of exhaust gas to change the output from the exhaust gas sensor 13. Therefore, it is preferred that the lengths of the respective exhaust communication passages 11 are set to such values as to prevent the resonance of pressure pulsations in a regular rotational range of the internal combustion engine.

Figure 15:
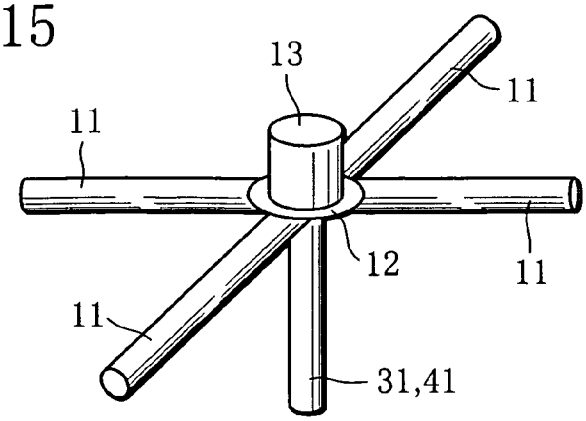
FIG. 15 is a perspective view showing the arrangement of exhaust communication passages relative to an intake communication passage or an exhaust downstream communication passage in a multicylinder internal combustion engine according to an eighth embodiment of the present invention.

FIG. 15 is a perspective view showing the arrangement of the exhaust communication passages relative to the intake communication passage or the exhaust downstream communication passage in the multicylinder internal combustion engine according to the eighth embodiment of the present invention. In the eighth embodiment, the exhaust communication passages 11 are arranged at substantially regular intervals about the intake communication passage 31 or the exhaust downstream communication passage 41. Other than that, the multicylinder internal combustion engine of the eighth embodiment is identical in construction with that of the first embodiment, and therefore differences between them will be intensively described below.

One ends of the four exhaust communication passages 11 are connected to the sensor fixing base 12 to which the exhaust gas sensor 13 is attached. The exhaust communication passages 11 are arranged at regular intervals of 90 degrees about the sensor fixing base 12 on a substantially horizontal plane. Although not illustrated, the other ends of the exhaust communication passages 11 are connected to the branches 3 of the exhaust manifold 1 for the respective cylinders. One end of the intake communication passage 31 of the third embodiment or the exhaust downstream communication passage 41 of the fourth embodiment is connected to the lower surface of the sensor fixing base 12, and the other end of the communication passage 31 or 41 is connected to the intake manifold 32 of the internal combustion engine or the downstream side of the catalyst 9 in the exhaust pipe 6.

Because the communication passages 11, 31, and 41 are arranged as described above, the exhaust communication passages 11 are located at substantially equal intervals about the intake communication passage 31 or the exhaust downstream communication passage 41. Therefore, exhaust gases from the exhaust communication passages 11 flow into the intake communication passage 31 or the exhaust downstream communication passage 41 via the exhaust gas sensor 13 under substantially the same conditions. Thus, the whole circumference of the detector 13*a* of the exhaust gas sensor 13 can be effectively used for detecting the air-fuel ratio to thereby improve responsiveness. Also, the problem that the effect of the air-fuel ratio of a specific cylinder is increased or decreased can be solved, so that the exhaust air-fuel ratio can be accurately determined with the air-fuel ratios of the respective cylinders being uniformly reflected.

By the way, in the case where the intake communication passage 31 is connected to the exhaust gas sensor 13 as in the third embodiment, the amount of exhaust gas flowing through the exhaust gas sensor 13 increases with an increase in the ratio of exhaust pressure to intake pressure. Then, at a time point the pressure ratio reaches a critical ratio,i.e., a critical state, the increase in the flow rate of exhaust gas is limited. If this critical state is caused to occur at the outlet or inlet of the exhaust gas sensor using the above phenomenon, various advantages can be obtained. A description will now be given of ninth and tenth embodiments of the present invention.

In the ninth embodiment, to reduce the effects of dependence on pressure on the exhaust gas sensor 13, the cross-sectional areas of the exhaust communication passage 11 and the intake communication passage 31 are set such that the critical state occurs at the outlet side of the exhaust gas sensor 13. Specifically, the total sum of the effective cross-sectional areas of the junctions of the exhaust communication passages 11 and the exhaust gas sensor 13 is set to be larger than the effective cross-sectional area of the junction of the intake communication passage 31 and the exhaust gas sensor 13.

Figure 16:
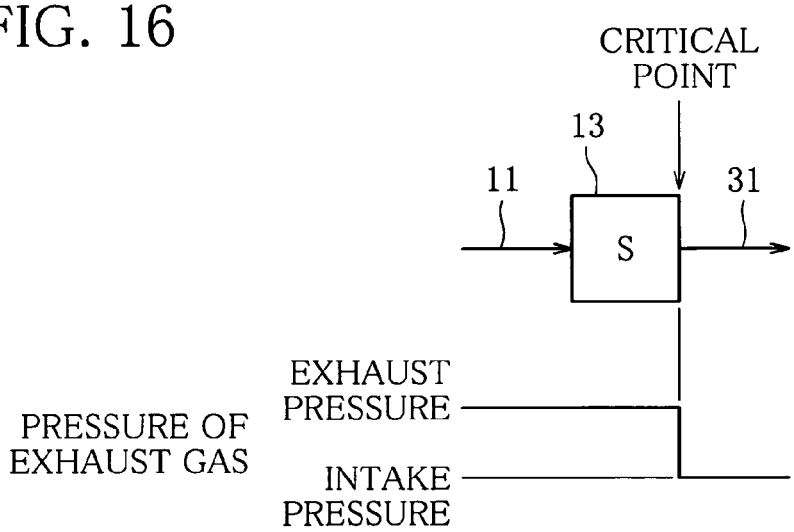
FIG. 16 is a view useful in explaining pressure distribution before and after an exhaust gas sensor when the exhaust gas pressure has reached a critical point in a multicylinder internal combustion engine according to a ninth embodiment of the present invention.

FIG. 16 is a view useful in explaining pressure distribution before and after the exhaust gas sensor 13 when the exhaust gas pressure has reached the critical state in the multicylinder internal combustion engine according to the present embodiment. Because the cross-sectional areas are set as mentioned above, as the ratio of exhaust pressure to intake pressure increases when exhaust gas flows, the exhaust gas pressure reaches the critical state earlier at the outlet side (intake communication passage 31 side) of the exhaust gas sensor 13 than at the inlet side (exhaust communication passage 11 side) of the exhaust gas sensor 13, and the increase in the flow rate of exhaust gas is limited at the outlet side of the exhaust gas sensor 13.

On this occasion, the pressure of exhaust gas acts as exhaust pressure in an area upstream of the outlet side of the exhaust gas sensor 13 and acts as intake pressure in an area downstream of the outlet side of the exhaust gas sensor 13. Therefore, exhaust pressure closer to the atmosphere as compared with intake pressure acts on the exhaust gas sensor 13. In general, the exhaust gas sensor 13 has the property of changing detecting characteristics depending on the pressure of exhaust gas. For this reason, exhaust pressure closer to the atmosphere acts on the exhaust gas sensor 13, and therefore, the effects of dependence on pressure can be reduced to improve the accuracy in determination of the exhaust air-fuel ratio.

The tenth embodiment of the present invention assumes a case where it is unnecessary to take measures to cope with dependence on pressure of the exhaust gas sensor 13 in the ninth embodiment, such as a case where the effect of dependence on pressure is small or a case where dependence on the pressure of gas is corrected. In the present embodiment, to make uniform the amount of exhaust gases flowing from the exhaust communication passages 11 into the exhaust gas sensor 13, the cross-sectional areas of the exhaust communication passages 11 and the intake communication passage 31 are set such that the critical status occurs at the inlet side of the exhaust gas sensor 13 contrary to the ninth embodiment. That is, the total sum of the effective cross-sectional areas of the junctions of the respective exhaust communication passages 11 and the exhaust gas sensor 13 is set to be smaller than the effective cross-sectional area of the junction of the intake communication passage 31 and the exhaust gas sensor 13. In the present embodiment, the effective cross-sectional areas of the junctions of the exhaust communication passages 11 are set to be equal.

Figure 17:
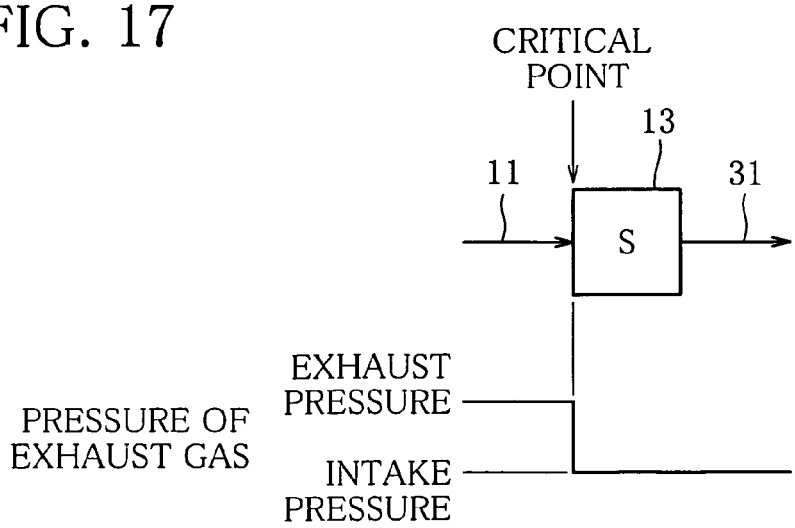
FIG. 17 is a view useful in explaining pressure distribution before and after an exhaust gas sensor when the exhaust gas pressure has reached a critical point in a multicylinder internal combustion engine according to a tenth embodiment of the present invention.

FIG. 17 is a view useful in explaining pressure distribution before and after the exhaust gas sensor 13 when the exhaust gas pressure has reached the critical state in the multicylinder internal combustion engine according to the present embodiment. Because the cross-sectional areas are set as mentioned above, as the ratio of exhaust pressure to intake pressure increases when exhaust gas flows, the exhaust gas pressure reaches the critical state earlier at the inlet side (exhaust communication passage 11 side) of the exhaust gas sensor 13 than at the outlet side (intake communication passage 31 side) of the exhaust gas sensor 13, and the increase in the flow rate of exhaust gas is limited at the inlet side of the exhaust gas sensor 13.

Since the pressure reaches the critical state earlier at the inlet of the exhaust gas sensor 13 and the effective cross-sectional areas of the junctions of the respective exhaust communication passages 11 and the exhaust gas sensor 13 are set to be equal as mentioned above, the amounts of exhaust gases flowing from the respective exhaust communication passages 11 into the exhaust gas sensor 13 are substantially equal. As a result, the exhaust air-fuel ratio can be accurately determined with the air-fuel ratios of the respective cylinders being uniformly reflected.

Although the present invention has been described in some detail by way of illustration for purposes of clarity of understanding, embodiments of the present invention are not limited to the above described ones. For example, although in the above described embodiments, the internal combustion engine is implemented by the straight four-cylinder engine, the number and arrangement of cylinders are not limited to the above described embodiments but may be arbitrarily changed insofar as the internal combustion engine is a multicylinder type.

Also, the arrangements of the above described embodiments should not necessarily be practiced individually, but may be practiced in arbitrary combinations. For example, the arrangement of the second embodiment in which the inflow part 21 of the exhaust communication passages 11 is disposed at a sharp angle to the exhaust gas flow line L1 may be combined with the arrangement of the fifth embodiment in which the cooling space 51 is provided in the exhaust downstream communication passage 41.

Further, the intake communication passage 31 may be connected to an EGR downstream passage, not to the intake manifold 32.

Further, if a difference in pressure is such that gas exchange cannot be facilitated (for example, intake pipe negative pressure increases, upstream exhaust pressure increases, and downstream exhaust pressure increases), determination of the air-fuel ratio can be temporarily interrupted.

Also, it is preferred that the relationships between ventilation holes formed in a protective cover for the exhaust gas sensor 13 and communication holes of the respective exhaust communication passages 11 from which exhaust gas flows into the exhaust gas sensor 13 are made uniform between the cylinders so as to solve the problems described below. Specifically, if the flow rate of exhaust gas (gas to be checked) flowing into the exhaust gas sensor 13 is high, the amount of gas to be checked flowing into the detector 13*a* of the exhaust gas sensor 13 varies according to whether a large number of or small number of the ventilation holes are formed in projected areas of the communication holes, causing the problem that the effect of variation in the air-fuel ratio of the cylinders is increased. The present invention can solve this problem.

Further, although in the above described embodiments, the cross-sectional area is uniform in each of the exhaust communication passages 11, intake communication passage 31, and exhaust downstream communication passage 41, the present invention is not limited to this, but the cross-sectional area may be minimum at only a part of each passage. Since exhaust gas passes through each passage, the cross-sectional area varies in each passage due to adhesion of deposits or the like. For example in the case where the effective cross-sectional areas of the respective exhaust communication passages 11 of the respective cylinders are not uniform, there is a variation in determination of the air-fuel ratio of the cylinders. However, since deposits or the like are not uniformly adhered into each passage, if the cross-sectional area is set to be minimum at a part of each passage, the possibility that deposits are adhered to the minimum cross-sectional area can be lowered.

Therefore, it is possible to lower the possibility that the effective cross-sectional areas of the exhaust passages of the respective cylinders are not uniform. As a result, the accuracy in determination of the air-fuel ratio is less likely to be deteriorated due to variation in the detected air-fuel ratio of the cylinders.

Further, it may be arranged such that exhaust gases led from the exhaust communication passages are mixed in a space of the exhaust gas sensor 13, and the air-fuel ratio of the exhaust gases thus mixed is determined by the exhaust gas sensor 13. Also, the air-fuel ratios of the respective cylinders may be individually determined without mixing exhaust gases.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A multicylinder internal combustion engine including a plurality of cylinders, comprising:

a first exhaust port side exhaust passage, one end of which being connected only to a first exhaust port;

a second exhaust port side passage, one end of which being connected only to a second exhaust port;

an exhaust passage junction where the first exhaust port side exhaust passage and the second exhaust port side exhaust passage join together;

a catalyst provided downstream of said exhaust passage junction, for purifying exhaust gas;

a first exhaust communication passage that allows a portion of exhaust gasses discharged only from the first exhaust port to pass therethrough;

a second exhaust communication passage that allows a portion of exhaust gasses discharged only from the second exhaust port to pass therethrough, the second exhaust communication passage being connected to the first exhaust communication passage; and an exhaust gas sensor provided where the second exhaust port is connected to the first exhaust port, wherein a length of the first exhaust communication passage being different from a length of the second exhaust communication passage.

2. A multicylinder internal combustion engine including a plurality of cylinders, comprising:

a cylinder head defining exhaust ports;

an exhaust passage adapted to receive exhaust gasses discharged from the exhaust ports;

a catalyst provided in said exhaust passage, for purifying exhaust gas;

a spacer member provided between the cylinder head and the exhaust passage, the spacer member defining exhaust communication passages in communication with all of the exhaust ports, said exhaust communication passages including a first exhaust communication passage that allows only a portion of exhaust gasses discharged from a first exhaust port, connected to the exhaust passage, to pass therethrough, and a second exhaust communication passage that allows only a portion of exhaust gasses discharged from a second exhaust port, connected to the exhaust passage, to pass therethrough; and an exhaust gas sensor provided in said exhaust communication passages, wherein the first exhaust communication passage passes the portion of exhaust gasses discharged from the first exhaust port to the exhaust gas sensor, and the second exhaust communication passage passes the portion of exhaust gasses discharged from the second exhaust port to the exhaust gas sensor, and wherein a distance from the exhaust ports to said exhaust gas sensor is shorter than a distance from the exhaust ports to an upstream inlet of said catalyst.

3. A multicylinder internal combustion engine according to claim 1, wherein said exhaust communication passages are in direct communication with the exhaust ports.

4. A multicylinder internal combustion engine according to claim 1, wherein:

said exhaust passage comprises a plurality of exhaust port side exhaust passages connected to the exhaust ports; and said exhaust communication passages are in communication with the exhaust ports via said exhaust port side exhaust passages.

5. A multicylinder internal combustion engine according to claim 2, wherein said spacer member defines an intake communication passage that brings said exhaust gas sensor into communication with an intake system of the multicylinder internal combustion engine, and facilitates the gas exchange in said exhaust communication passages due to a difference between exhaust pressure and intake pressure.

6. A multicylinder internal combustion engine including a plurality of cylinders, comprising:

a cylinder head defining exhaust ports;

exhaust port side exhaust passages adapted to receive exhaust gasses discharged from the exhausr ports;

exhaust passage junctions where at least two of said exhaust port side exhaust passages join together;

a catalyst provided downstream of said exhaust passage junctions, for purifying exhaust gas;

a spacer member provided between the cylinder head and the exhaust passage, the spacer member defining exhaust communication passages provided upstream of said exhaust passage junctions and in communication with all of said exhaust port side exhaust passages, said exhaust communication passages including a first exhaust communication passage that allows only a portion of exhaust gasses discharged from a first exhaust port, connected to one of said exhaust port side exhaust passages, to pass therethrough, and a second exhaust communication passage that allows only a portion of exhaust gasses discharged from a second exhaust port, connected to another one of said exhaust port side exhaust passages, to pass therethrough; and an exhaust gas sensor provided in said exhaust communication passages, wherein the first exhaust communication passage passes the portion of exhaust gasses discharged from the first exhaust port to the exhaust gas sensor, and the second exhaust communication passage passes the portion of exhaust gasses discharged from the second exhaust port to the exhaust gas sensor.

7. A multicylinder internal combustion engine according to claim 6, wherein said spacer member defines an intake communication passage that brings said exhaust gas sensor into communication with an intake system of the multicylinder internal combustion engine, and facilitates the gas exchange in said exhaust communication passages due to a difference between exhaust pressure and intake pressure.

8. A multicylinder internal combustion engine including a plurality of cylinders, comprising:

an exhaust passage connected to exhaust ports of respective ones of the cylinders;

a catalyst provided in said exhaust passage, for purifying exhaust gas;

exhaust communication passages in communication with at least two of the exhaust ports, said exhaust communication passages including a first exhaust communication passage that allows only a portion of exhaust gasses discharged from a first exhaust port, connected to the exhaust passage, to pass therethrough, and a second exhaust communication passage that allows only a portion of exhaust gasses discharged from a second exhaust port, connected to the exhaust passage, to pass therethrough;

an exhaust gas sensor provided in said exhaust communication passages; and gas exchange facilitating means for facilitating gas exchange in said exhaust communication passages, wherein the first exhaust communication passage passes the portion of exhaust gasses discharged from the first exhaust port to the exhaust gas sensor, and the second exhaust communication passage passes the portion of exhaust gasses discharged from the second exhaust port to the exhaust gas sensor, wherein a distance from the exhaust ports to said exhaust gas sensor is shorter than a distance from the exhaust ports to an upstream inlet of said catalyst, and wherein said gas exchange facilitating means comprises a cooling space provided downstream of said exhaust gas sensor, whereby volume change caused by cooling of exhaust gases in said cooling space facilitates the gas exchange in said exhaust communication passages.

9. A multicylinder internal combustion engine including a plurality of cylinders, comprising:

an exhaust passage connected to exhaust ports of respective ones of the cylinders;

a catalyst provided in said exhaust passage, for purifying exhaust gas;

exhaust communication passages in communication with at least two of the exhaust ports, said exhaust communication passages including a first exhaust communication passage that allows only a portion of exhaust gasses discharged from a first exhaust port, connected to the exhaust passage, to pass therethrough, and a second exhaust communication passage that allows only a portion of exhaust gasses discharged from a second exhaust port, connected to the exhaust passage, to pass therethrough;

an exhaust gas sensor provided in said exhaust communication passages; and gas exchange facilitating means for facilitating gas exchange in said exhaust communication passages, wherein the first exhaust communication passage passes the portion of exhaust gasses discharged from the first exhaust port to the exhaust gas sensor, and the second exhaust communication passage passes the portion of exhaust gasses discharged from the second exhaust port to the exhaust gas sensor, wherein a distance from the exhaust ports to said exhaust gas sensor is shorter than a distance from the exhaust ports to an upstream inlet of said catalyst, and wherein said gas exchange facilitating means comprises an intake communication passage that brings said exhaust gas sensor into communication with an intake system of the multicylinder internal combustion engine, and facilitates the gas exchange in said exhaust communication passages due to a difference between exhaust pressure and intake pressure.

10. A multicylinder internal combustion engine according to claim 9, wherein said exhaust communication passages are arranged at substantially regular intervals about said intake communication passage.

11. A multicylinder internal combustion engine including a plurality of cylinders, comprising:

an exhaust passage connected to exhaust ports of respective ones of the cylinders;

a catalyst provided in said exhaust passage, for purifying exhaust gas;

exhaust communication passages in communication with at least two of the exhaust ports, said exhaust communication passages including a first exhaust communication passage that allows only a portion of exhaust gasses discharged from a first exhaust port, connected to the exhaust passage, to pass therethrough, and a second exhaust communication passage that allows only a portion of exhaust gasses discharged from a second exhaust port, connected to the exhaust passage, to pass therethrough;

an exhaust gas sensor provided in said exhaust communication passages; and gas exchange facilitating means for facilitating gas exchange in said exhaust communication passages, wherein the first exhaust communication passage passes the portion of exhaust gasses discharged from the first exhaust port to the exhaust gas sensor, and the second exhaust communication passage passes the portion of exhaust gasses discharged from the second exhaust port to the exhaust gas sensor, wherein a distance from the exhaust ports to said exhaust gas sensor is shorter than a distance from the exhaust ports to an upstream inlet of said catalyst, and wherein said gas exchange facilitating means comprises an exhaust downstream communication passage that brings said exhaust gas sensor into communication with an area downstream of a location at which said exhaust communication passages are in communication with an exhaust system of the internal combustion engine, and facilitates the gas exchange in said exhaust communication passages due to a difference in pressure between an upstream side and a downstream side of the exhaust system.

12. A multicylinder internal combustion engine according to claim 11, wherein said exhaust communication passages are arranged at substantially regular intervals about said exhaust downstream communication passage.

* * * * *